United States Patent [19]

La Pour

[11] 3,999,243

[45] Dec. 28, 1976

[54] LEAF AND DEBRIS BLOWER FOR GOLF GREENS

[76] Inventor: Robert H. La Pour, 6000 5-Mile Road, Racine, Wis. 53402

[22] Filed: Feb. 27, 1975

[21] Appl. No.: 553,560

[52] U.S. Cl. ..... 15/344; 15/369; 15/405; 15/415 R; 273/32 B; 273/162 F

[51] Int. Cl.[2] ..... A47L 5/14

[58] Field of Search ..... 15/316, 330, 344, 345, 15/346, 368, 369, 373, 405, 415, 420, 401, 406; 273/32 B, 162 R, 162 F

[56] References Cited

UNITED STATES PATENTS

| | | | |
|---|---|---|---|
| 1,423,190 | 7/1922 | Clements | 15/330 X |
| 1,657,322 | 1/1928 | Shinn | 273/32 B X |
| 2,047,677 | 7/1936 | Edstrom | 15/373 |
| 2,586,145 | 2/1952 | Breuer et al. | 15/405 X |

FOREIGN PATENTS OR APPLICATIONS

| | | | |
|---|---|---|---|
| 805,909 | 12/1958 | United Kingdom | 15/344 |

*Primary Examiner*—Leonard D. Christian
*Assistant Examiner*—C. K. Moore
*Attorney, Agent, or Firm*—Axel H. Johnson

[57] ABSTRACT

A blower to clear obstructions such as leaves from a golf green in preparation to "putting" the ball, comprising a head having a slit to be positioned in proximity to the surface of the green. A tubular shaft extends upwardly from the head and terminates in a housing containing a motor having a fan. Batteries in the housing provide current to operate the motor upon actuation of a switch. The fan causes air to flow through the slit to blow the obstructions from the surface of the green in preparation for "putting" the ball. A brush can be positioned on the head to remove obstructions too heavy to be moved by the air stream.

1 Claim, 5 Drawing Figures

LEAF AND DEBRIS BLOWER FOR GOLF GREENS

BACKGROUND OF THE INVENTION

1. Field of the Invention

This invention relates to a device that facilitates the "putting" of a golf ball on the green by removing obstructions from the path of the ball.

2. Description of the Prior Art

There is no knowledge of an existing device similar to that disclosed herewith.

SUMMARY OF THE INVENTION

This invention concerns a means of removing leaves and other obstructions from the pathway of a golf ball when "putting" it toward the hole. It comprises a tubular shaft positioned substantially vertically when in use. A head is positioned at the lower end of the shaft, and which head has a slit communicating with the bore of the shaft. The upper end of the shaft terminates in a casing or housing having a motor therein provided with a fan. Batteries are also enclosed in the housing and a switch controls the circuit that provides energy to the motor. When in use, this device is positioned with the head resting on the surface of the green and directed normal to the direction of the ball when struck. The switch is then closed and the air stream escaping through the slit will dislodge leaves or other similar obstructions from the path of the ball, which then can be "putted" along a path free of obstructions. If the obstruction is of too heavy a nature to be moved by the air flow from the slit, a brush which is mounted on the rear of the head can be employed to sweep the obstruction from the intended path of the ball. This device is to be carried in the golf bag with the clubs.

Referring to the drawings.

Figure 1:
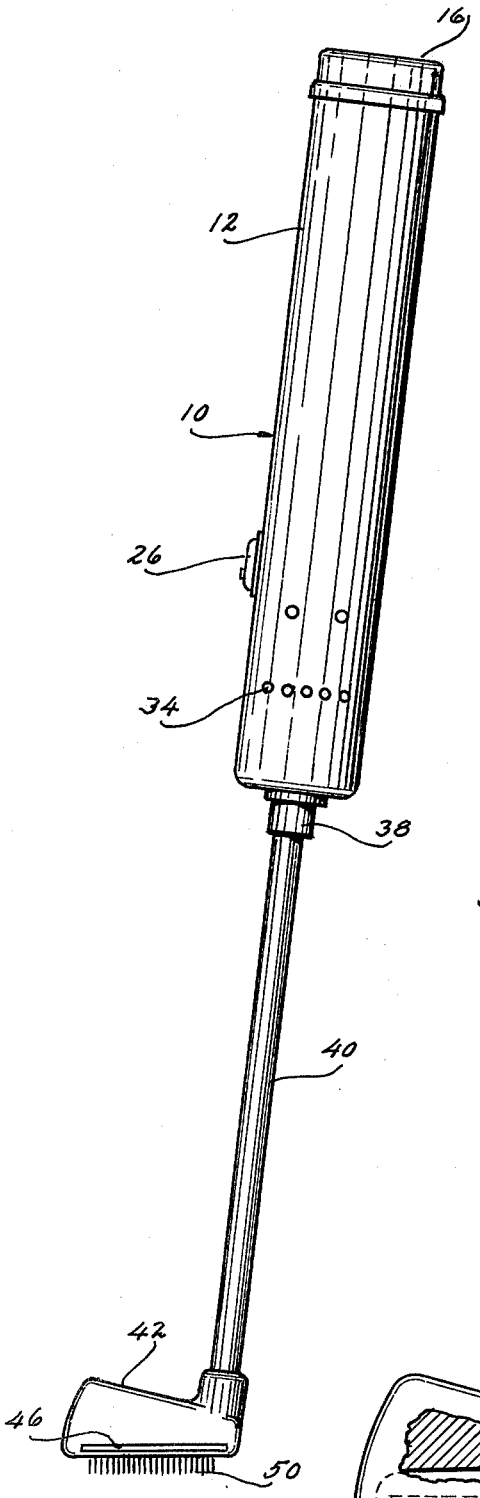
FIG. 1 is an upright view of the blower in position for use.
Figure 2:
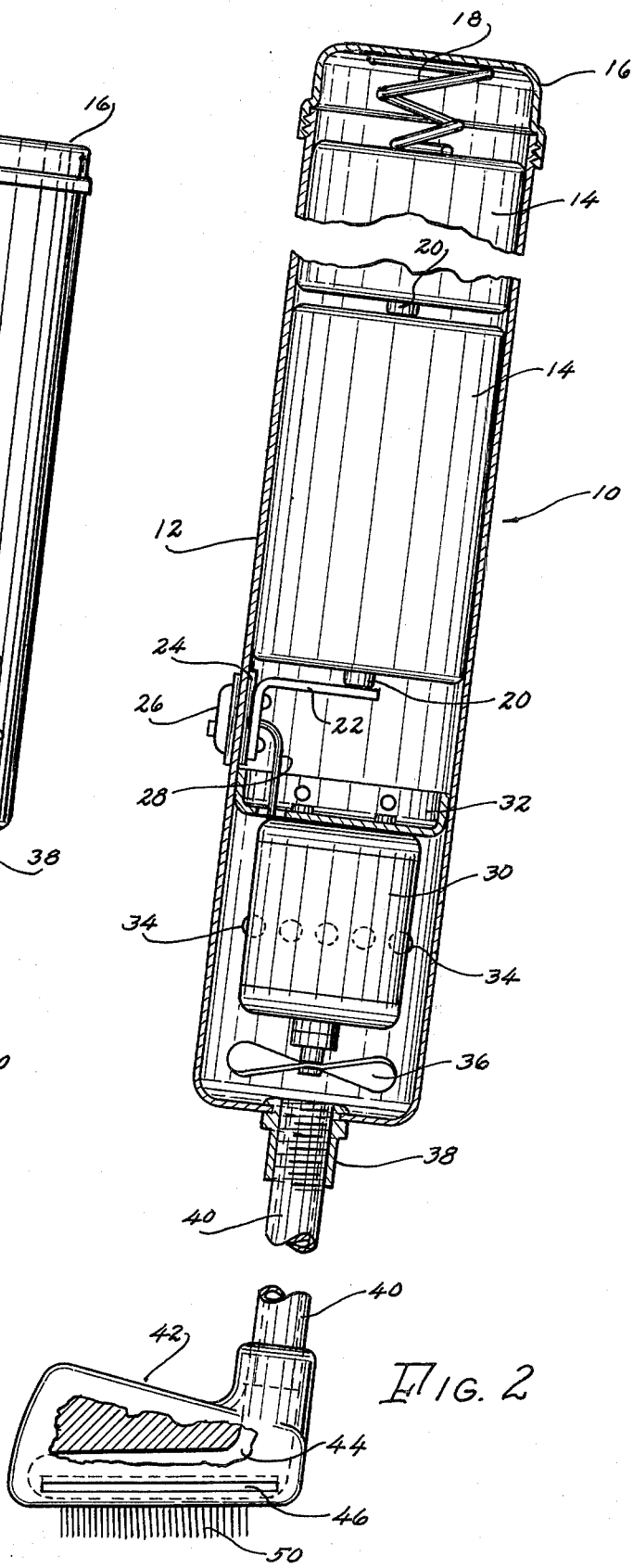
FIG. 2 is an enlarged view of the blower in section and showing details, and having parts broken away.
Figure 4:
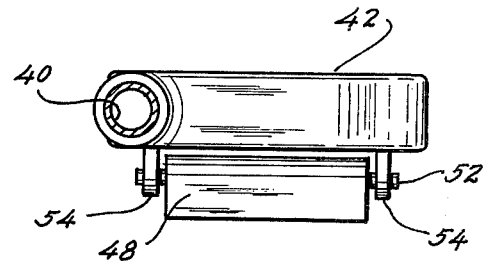
FIG. 4 is a view taken in the direction of 4—4 of FIG. 3.

Referring to FIG. 1 the blower comprises a tubular metal housing 12 which encloses a plurality of batteries and a motor. FIG. 2 shows the various elements in detail. Housing 12 is of the shape shown and encloses a plurality of batteries 14 to provide the energy required. The length and diameter of the container 12 varies according to the number of batteries required to supply the energy. A screw cap 16 is threadedly assembled on container 12 and has integral therewith a spring member 18 which provides the "ground" or negative connection terminal by contacting the bottom of the first cell 14. Each cell 14 has a button 20 which in succession contacts the bottom of the next cell 14. The final button 20 contacts an angle member 22 which is insulated from the container or housing 12 by insulating member 24. A switch 26 is mounted on housing 12. An insulated lead wire 28 is connected between switch 26 and a motor 30. The motor 30 will therefore function upon closing of the switch 26. A mounting disk 32 supports motor 30 centrally and provides the "ground" connection therefor. A plurality of openings 34 are provided in container or housing 12 to supply air to a suitable fan 36 which is mounted upon the shaft of motor 30.

Figure 5:
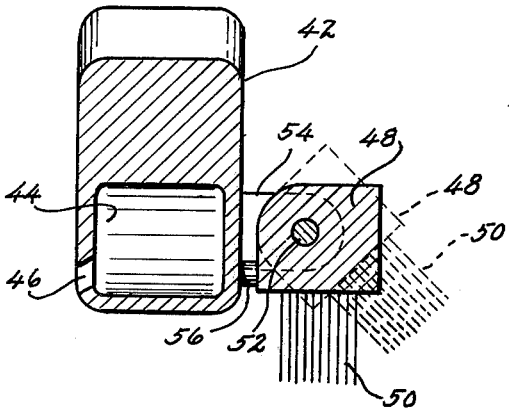
FIG. 5 is an enlarged section taken at 5—5 of FIG. 3.
Figure 3:
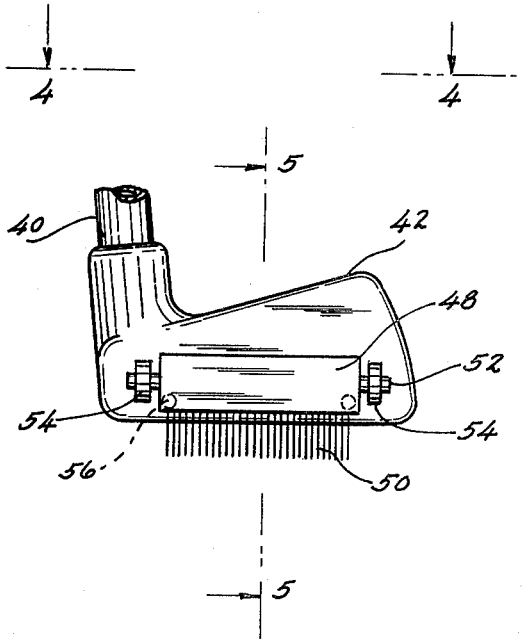
FIG. 3 is an enlarged rear view of the head.

Container or housing 12 terminates at the lower end thereof in a boss 38 which is suitably secured to the container 12. A tubular member 40 extends downwardly and is threadedly secured in boss 38, and can be removed therefrom for disassembly. The extreme lower end of member 40 terminates in a head 42 which has provided therein a chamber 44. A slit 46 in the front face of head 42 communicates with the chamber 44 to permit a continuous flow of air from the fan 36, through tubular member 40, chamber 44 and outwardly through slit 46; the latter being directed downwardly as shown in FIG. 5, thereby more effectively blow leaves or other obstructions from the path of the ball. A brush 48 is mounted rearwardly of head 42 to permit removal of heavy obstructions which do not respond to the stream of air flowing from the slit 46. Brush 48 comprises a body of suitable material having bristles 50 that extend below the lower surface of head 42, and is pivoted on a shaft 52. Head 42 has integral therewith posts 54 which support shaft 52. When there are obstructions not removable by the stream of air escaping from slit 46, the blower 10 is directed manually rearwardly with the brush in contact with the obstruction. Studs 56, are integral with head 42 and provide abutments for the brush 48 relative to the head 42. When the blower 10 is held with slit 46 directed toward an obstruction, and in proximity to the surface of the green, brush 48 will pivot freely rearwardly to permit the head 42 to contact the surface of the green, as shown in dotted lines of FIG. 5.

It should be understood that the diameter and length of the housing is contingent upon the size of the motor 30 necessary to provide an adequate air stream flowing from the slit 46, and to provide space for batteries that will provide sufficient energy.

The above being a complete description of an illustrative embodiment of the invention, what is claimed and desired to be secured by Letters Patent of the United States is:

1. A blower to remove obstructions from the path of a golf ball being "putted" on a green, comprising a housing having an opening to permit entry of air thereto, a motor in said housing having a fan, power cells in said housing, a power circuit to energize said motor, means to make-and-break said circuit, a tubular member defining a passageway and extending from said housing and positioned to permit air to flow from said fan through said passageway, said tubular member terminating in a head spaced from said housing, said head having a front face, a rear face and a lower face, and a chamber communicating with said passageway, a slit being provided in said front face and communicating with said chamber to permit air flowing from said fan to pass through said passageway, said chamber and said slit to engage said obstructions, and a brush pivotally affixed to said rear face, the bristles of said brush extending below said lower face.

* * * * *